United States Patent [19]

Ihama et al.

[11] Patent Number: 4,693,965

[45] Date of Patent: Sep. 15, 1987

[54] METHOD FOR MANUFACTURING A SILVER HALIDE EMULSION

[75] Inventors: Mikio Ihama; Tadaaki Tani, both of Kanagawa, Japan

[73] Assignee: Fuji Photo Film Co., Ltd., Kanagawa, Japan

[21] Appl. No.: 802,285

[22] Filed: Nov. 27, 1985

[30] Foreign Application Priority Data

Dec. 3, 1984 [JP] Japan ..... 59-255477

[51] Int. Cl.[4] ..... G03C 1/18; G03C 1/08

[52] U.S. Cl. ..... 430/569; 430/605; 430/585; 430/567; 430/588

[58] Field of Search ..... 430/569, 605, 585, 567, 430/588

[56] References Cited

U.S. PATENT DOCUMENTS

| | | | |
|---|---|---|---|
| 3,628,960 | 12/1971 | Phillippaerts et al. | 430/571 |
| 4,225,666 | 9/1980 | Locker et al. | 430/569 |
| 4,288,535 | 9/1981 | Kanisawa et al. | 430/569 |

OTHER PUBLICATIONS

Research Disclosure 17643, Dec. 1978, pp. 22–31.

*Primary Examiner*—Won H. Louie

*Attorney, Agent, or Firm*—Sughrue, Mion, Zinn, Macpeak, and Seas

[57] ABSTRACT

A method for manufacturing a chemically and spectrally sensitized silver halide emulsion is described, which comprises carrying out chemical ripening of the emulsion in the presence of an iridium salt and a photographic spectral sensitizing dye.

30 Claims, No Drawings

METHOD FOR MANUFACTURING A SILVER HALIDE EMULSION

FIELD OF THE INVENTION

The present invention relates to a method for manufacturing a chemically and spectrally sensitized silver halide emulsion, and more particularly to a method for manufacturing a chemically and spectrally sensitized silver halide emulsion by carrying out chemical ripening under specified conditions.

BACKGROUND OF THE INVENTION

Generally, a silver halide emulsion is prepared through the process of formation of silver halide grains by double decomposition of a soluble silver salt with a soluble halide in a aqueous gelatin solution, and then conducting a physical ripening process, a desalting process, and a chemical ripening process of the resulting emulsion.

A spectral sensitizing dye is, in general, added to a photographic emulsion already chemically sensitized before it is applied to a support. In U.S. Pat. No. 4,425,426 and the like, however, a method for adding a spectral sensitizing dye to a photographic emulsion before the beginning of or during the course of its chemical sensitization was disclosed. Further, in U.S. Pat. Nos. 2,735,766, 3,628,960, 4,183,756, and 4,225,666, methods for adding a spectral sensitizing dye to a photographic emulsion before completion of formation of silver halide grains were disclosed.

More particularly, in U.S. Pat. Nos. 4,183,756 and 4,225,666, it was disclosed that a method for adding a spectral sensitizing dye to a photographic emulsion after formation of stable nuclei during the formation process of silver halide grains had advantages such as an increase in photographic sensitivity and strengthened adsorption of the spectral sensitizing dye by silver halide grains.

In techniques disclosed so far relating to the spectral sensitization of photographic emulsions, the chemical ripening was always carried out in the presence of a spectral sensitizing dye. In such cases, however, the presence of spectral sensitizing dye likely reduces the photographic sensitivity of the emulsion.

SUMMARY OF THE INVENTION

A first object of the invention is to provide an improved spectral sensitizing method and an improved chemical sensitizing method for a silver halide emulsion by which the adsorption of dye is strengthened and high sensitivity of the emulsion can be obtained.

A second object of the invention is to provide an improved spectral sensitizing method and an improved chemical sensitizing method for a silver halide emulsion by which the desensitizing effect of the dye can be repressed markedly.

A third object of the invention is to provide an improved spectral sensitizing method and an improved chemical sensitizing method for a silver halide emulsion which allows for addition of a large amount of spectral sensitizing dye while repressing the desensitizing effect of the dye.

It has now been found that improved silver halide emulsions having high photographic sensitivity and strengthened adsorbing power for a spectral sensitizing dye can be manufactured by a method which comprises carrying out chemical ripening of the emulsion in the presence of an iridium salt and a photographic spectral sensitizing dye. In addition, the inventors have also found that the desensitizing effect of the dye can be repressed markedly and improved chemically and spectrally sensitized silver halide emulsions can be manufactured by the method. Furthermore, the inventors have found that improved silver halide emulsions wherein the desensitizing effect of the dye can be repressed even with an addition of a large amount of spectral sensitizing dye can be manufactured by the method.

DETAILED DESCRIPTION OF THE INVENTION

The addition time for a spectral sensitizing dye can be selected during the period of chemical ripening or at a time before the beginning of chemical ripening. In other words, in the formation process of the silver halide emulsion grains, the spectral sensitizing dye may be added to the gelatin solution before the addition of a silver salt solution or during the addition period of the silver salt solution, and the dye may be added during a period from the finish of addition of the silver salt solution to the beginning of the chemical ripening, or the dye may be added during the chemical ripening process, preferably during a period from the beginning of the chemical ripening process to a time point corresponding to 50% of the process period, further preferably during a period from the beginning of the process to a time point corresponding to 20% of the process period.

The spectral sensitizing dye can be added to a photographic emulsion in the form of its solution in water or in an organic solvent. A substantially water soluble spectral sensitizing dye can be used in the form of a dispersion of it in a water-insoluble solvent, as disclosed, for example, in the specification of Japanese Patent Application No. 53867/1984 (corresponding to U.S. Ser. No. 714,316 filed Mar. 21, 1985). The total amount of spectral sensitizing dye may be either added at once, divided to be added at several times, or continuously added over a predetermined time period.

The sensitizing dye for use in the invention is not specially limited. Examples of useful sensitizing dyes include methine dyes and styryl dyes such as cyanine dyes, merocyanine dyes, hemicyanine dyes, rhodacyanine dyes, oxonole dyes, and hemioxonole dyes.

Particularly useful examples of the dye in the invention are cyanine dyes which form J-aggregates on the silver halide grains. Further, examples of useful dyes are carbocyanine dyes which form J-aggregates. The J-aggregates of dyes are described in, for example, *The Theory of the Photographic Process* (Fourth Edition), edited by T. H. James (MacMillan Publishing Co., Inc., 1977), Chapter 8, *Sensitizing and Desensitizing Dyes* (written by D. M. Sturmer and D. W. Heseltine).

Additional spectral sensitizing dyes that can be used include those described in West German Patent No. 929,080, U.S. Pat. Nos. 2,493,748, 2,503,776, 2,519,001, 2,912,329, 3,656,959, 3,672,897, 3,694,217, 4,025,349, 4,046,572, 2,688,545, 2,977,229, 3,397,060, 3,522,052, 3,527,641, 3,617,293, 3,628,964, 3,666,480, 3,672,898, 3,679,428, 3,703,377, 3,814,609, 3,837,862, and 4,026,707, British Pat. Nos. 1,242,588, 1,344,281, and 1,507,803, Japanese Patent Publication Nos. 14,030/1969, 24,844/1977, 4,936/1968, and 12,375/1978, Japanese Patent Application Nos. (OPI) 110,618/1977, 109,925/1977, and 80,827/1975, (the term "OPI" as used herein refers to a "published unexamined Japanese patent application") and the like.
Typical examples of the sensitizing dye which is suitably used in the present invention are given below.
Dye-1
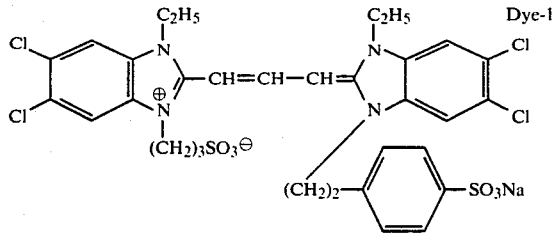
Dye-2
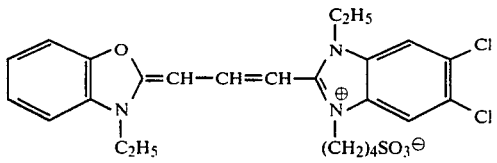
Dye-3
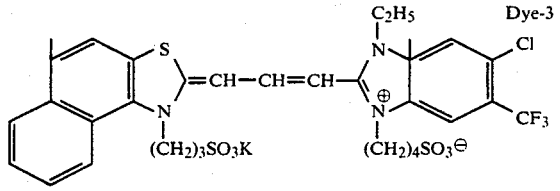
Dye-4
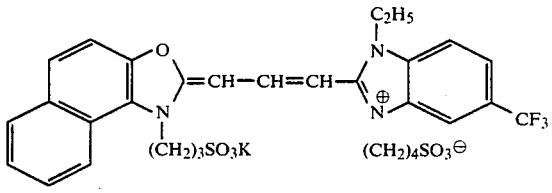
Dye-5
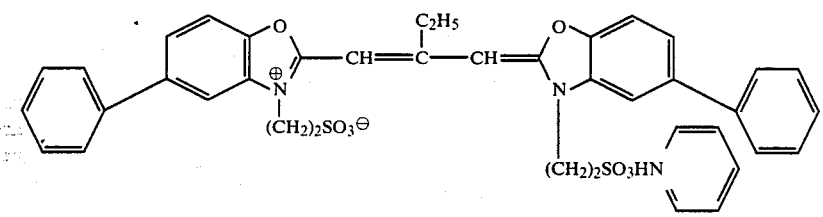
Dye-6
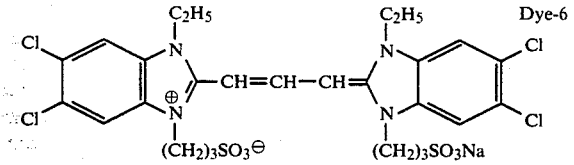
Dye-7
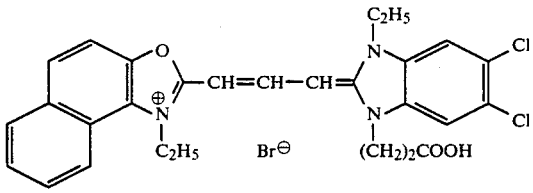
Dye-8
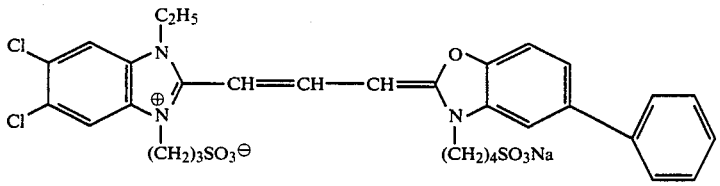
Dye-9
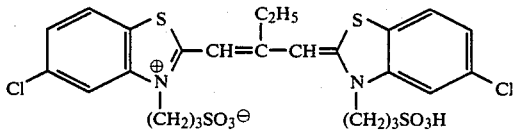
Dye-10
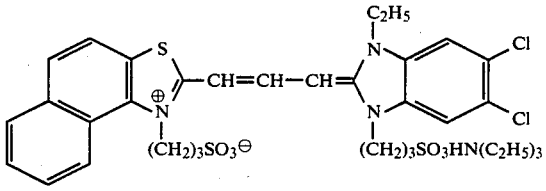
Dye-11
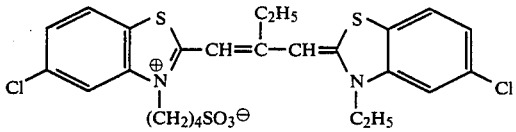
Dye-12
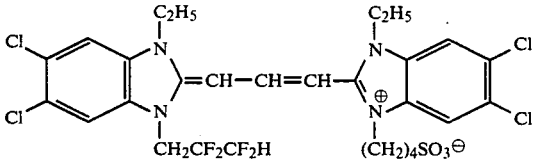

-continued

Dye-13

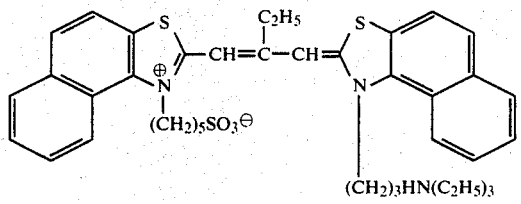

Dye-14

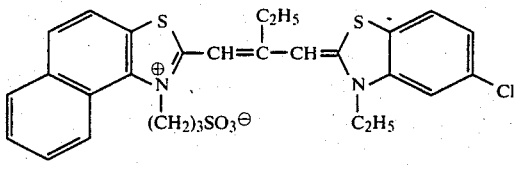

Dye-15

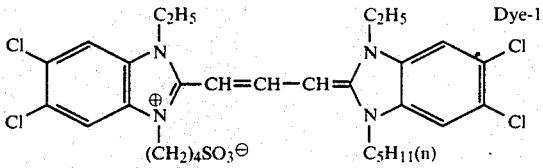

Dye-16

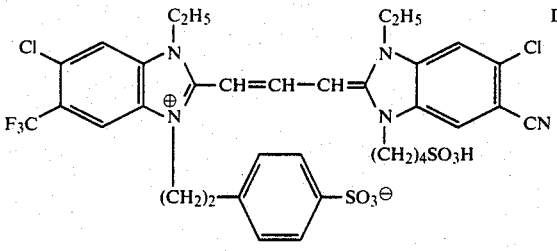

Dye-17

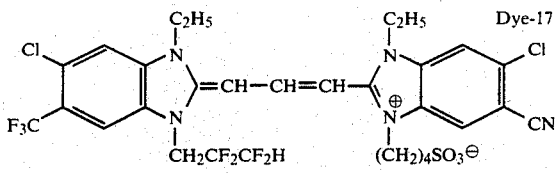

Dye-18

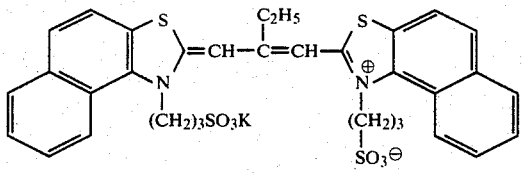

The optimum amount of spectral sensitizing dye added to a silver halide emulsion when it is prepared varies with the type of additives and with the amount of silver halides. However, the spectral sensitizing dye can generally be employed in amounts substantially equal to the amounts used in conventional methods.

In other words, the preferred amount of sensitizing dye added is from 0.01 to 10 mmol per mol of silver halide, and the further preferred amount of the sensitizing dye is from 0.1 to 1 mmol per mol of silver halide.

The addition time for the iridium salt can be selected during the period of chemical ripening process or at a time before the beginning of chemical ripening. In other words, in the formation process of silver halide emulsion grains, the iridium salt may be added to the gelatin solution during the addition period of a silver salt solution, the iridium salt may be added during a period from the finish of addition of the silver salt solution to the beginning of the chemical ripening process, or the iridium salt may be added during the period of chemical ripening process, preferably during a period from the beginning of the chemical ripening process to a time point corresponding to 50% of the process period, further preferably during a period from the beginning of the process to a time point corresponding to 20% of the process period. When the iridium salt is added during a period from a time point at which 70% or more, preferably 80% or more, further preferably 90% or more, of the whole silver salt solution has been added to the gelatin solution to the completion of addition of the whole silver salt solution, the iridium salt is especially effective.

As the iridium salt for use in the invention, $Ir(Xi)_3$, $Ir(Xi)_4$, $Y_2Ir(Xi)_6$ or $Y_3Ir(Xi)_6$ can be used. Xi(i=1,2, . . . ) is a ligand for iridium ions Ir(IV) or Ir(III). The ligand can be selected from among $Cl^-$, $Br^-$, $I^-$, $H_2O$ and the like and the ligands which may all be the same or different may be combined for use. $Cl^{-0}$ and $Br^-$ are preferred and $Cl^-$ is especially preferred. Y represents a pair of ions for iridium complex ions, and can be selected from among $K^+$, $Na^+$, $NH_4^+$, and the like. Examples of the iridium salt include hexahalogenocomplex salts of iridium such as the salt of hexahalogenoiridium(III) acids and the salt of hexahalogenoiridium(IV) acids and iridium halides such as iridium(III) chloride, iridium(IV) chloride, iridium(III) bromide, iridium(IV) bromide, and the like.

The amount of iridium ions used in the invention cannot be unequivocally determined because it varies depending upon the addition method and the amount of silver halide used. However, the amount of iridium ions used per mol of silver halide is generally from $10^{-8}$ to $10^{-2}$ mol, preferably from $10^{-6}$ to $10^{-3}$, and more preferably from $10^{-5}$ to $10^{-3}$ mol.

In the silver halide emulsions for use in the invention, any one of silver bromide, silver iodobromide, silver iodochlorobromide, silver chlorobromide, silver chloride, and the like may be used as the silver halide.

Silver halide grains may be either of double structure having different phases in the inside and in the surface layer, of multiphase structure having joined structure, or of single uniform structure having a single phase over the whole grain. Further, silver halide grains may be a mixture of the above-mentioned types of grains.

The particle size of silver halide grains is not specially limited. However, it is preferred that the average particle size of silver halide grains is 3 microns or less and 0.1 micron and over. Herein, the diameter of spherical or nearly spherical silver halide grains is taken as the particle size of the grains and the edge length of cubic silver halide grains is taken as the particle size of the grains, and the average particle size of silver halide grains is represented by the average value of the particle size of the grains based on the projected area of grains. The particle size distribution may be narrow or may be wide. In the invention, a so-called monodisperse silver halide emulsion can be used, which has a narrow particle size distribution of grains such that 90% or more, and preferably 95% or more, of the entire number of grains or the entire weight of grains have a particle size within a range of ±40% of the average particle size of grains.

The form of silver halide grains for use in the invention include cubic, octahedral, tetradecahedral, plate-like (tabular), pebble-like and the like. Of these, an octahedral form, a plate-like form, a pebble-like form and a tetradecahedral form as preferred; the plate-like form and the octahedral form are particularly preferred, and the octahedral form is most particularly preferred.

Of emulsions containing plate-like grains of silver halide, an emulsion is preferred in which the projected area of tabular grains having a ratio of length to thickness of 5/1 or more, and particularly 8/1 or more, accounts for 50% or more of the total projected area of the entire grains.

The emulsion for use in the invention may be an emulsion comprising a mixture of various crystalline forms of grains. These various emulsions may be of surface latent image type having a latent image formed mainly on the grain surface or may be of internal latent image type having a latent image formed mainly inside the grain.

It is preferred that silver halide grains for use in the invention have a crystal face (111) as the habit of the grains. It is preferred that the area of the crystal face (111) in relation to the total surface area of grain is 30% or more, it is more preferred that the area is 60% or more, and it is most preferred that the area is 90% or more.

Regarding determination of the area of the crystal face (111), the method noted in the *Journal of Japan Chemical Society,* 1984, No. 6, page 942, can be used. According to the method, a ratio of the face (100) to the face (111) can be determined according to the reflection spectrum of thick layer of a liquid emulsion with an addition of various amounts of 3,3'-bis(4-sulfobutyl)-9-methyl-thiacarbocyanine dye, using the formula of Kubelka-Munk.

These silver halide emulsions can be prepared easily by methods described in the technical literatures such as *Chimie et Physique Photographique* by P. Glafkides (Paul Montel Co., 1967), *Photographic Emulsion Chemistry* by G. F. Duffin (The Focal Press, 1966), *Making and Coating Photographic Emulsion* by V. L. Zelikman et al. (The Focal Press, 1964), and the like.

Any one of an acid method, neutral method, ammonia method, or the like may be used, and as a method for reacting a soluble silver salt with a soluble halide salt, any one of a one side mixing method, a simultaneous mixing method, and the combination of the two may be used.

A method for forming grains in the presence of excessive silver ions (that is, a so-called reverse mixing method) can also be used. As a form of the simultaneous mixing method, a method for maintaining pAg in a liquid phase in which silver halides are formed at a constant rate, that is, a so-called controlled double jet method, may be used.

In the formation process of silver halide grains or in the physical ripening process of emulsion, cadmium salts, zinc salts, lead salts, thallium salts, rhodium salts or its complex salts, ion or its complex salts, or the like may be present for various pourposes such as, for example, to achieve hard toning, sensitization, desensitization, and internal latent image formation.

If the silver halide emulsion is physically ripened in the presence of a known solvent for silver halides (for example, ammonia or potassium rhodanate, or thioethers and thione compounds mentioned in U.S. Pat. No. 3,271,157 and in Japanese Patent Applications (OPI) 12360/1976, 82408/1978, 144319/1978, 100717/1979, and 155828/1979), a monodisperse emulsion having a regular crystalline form and nearly uniform particle size distribution can be obtained.

After completion of grain formation in the photographic emulsion (that is, after precipitate formation of silver halide grains or after physical ripening of emulsion), removal of soluble salts from the emulsion (that is, the desalting process) is usually carried out. For that purpose, a noodle washing method with water known for long which is carried out after the gelatin is allowed to gel may be used, or a flocculation method employing an inorganic salt comprising polyvalent anions, such as sodium sulfate, an anionic surface active agent, or an anionic polymer (for example, polystyrene sulfonic acid) or a gelatin derivative (for example, aliphatic acylated gelatin, aromatic acylated gelatin, aromatic carbamoyled gelatin, or the like) may be used.

The form of silver halide grains can be determined from the electron micrograph of the grains by a carbon replica method. The particle size and particle size distribution of silver halide grains can be measured with a optical microscope, an electron microscope, a Coulter Counter and a Quantimet image analyzer. The electron micrograph of silver halide grains and a measuring method for the particle size thereof are described in *The Theory of the Photographic Process* (Fourth Edition), edited by T. H. James (MacMillan Publishing Co., Inc., 1977), Chapter 3, *Precipitation and Growth of Silver Halide Emulsion Grains* (written by C. R. Berry).

The silver halide emulsion is usually sensitized chemically. For the chemical sensitization, methods as noted in *Grundlagen der Photographischen Prozesse mit Silberhalogeniden*, edited by H. Frieser (Akademische Verlagsgesellschaft, 1968), pages 675–734, can be used.

Chemical sensitizing methods that can be used include a sulfur sensitizing method employing compounds containing sulfur reactable with active gelatin or silver (for example, thiosulfates, thioureas, mercapto compounds, and rhodanines), a reduction sensitizing method employing reducing substances (for example, stannous salts, amines, hydrazine derivatives, formamidinesulfinic acid, and silane compounds), a noble metal sensitizing method employing noble metal compounds (for example, gold complex salts and complex salts of the VIII group metal in Periodic Chart such a Pt, Ir, Pd, and the like), etc., and these can be used individually or in combination with each other.

Sulfur sensitization and the combination of sulfur sensitization with gold sensitization are, in particular, preferred in the invention.

Various compounds can be contained in the emulsion for use in the invention with the aim of preventing the fogging of sensitized materials in the manufacturing process thereof, during preservation thereof, or during a photographic treatment thereof, or with the aim of stabilizing the photographic performance of sensitized materials. Compounds known as antifogging agents or as stabilizers that can be added to the emulsion include azoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole), and the like; mercaptopyrimidines; mercaptotriazines; thioketone compounds such as oxadorinethione; azaindenes, for example, triazaindenes, tetrazaindenes (in particular, 4-hydroxy-substituted (1,3,3a, 7)-tetrazaindenes), pentazaindenes, and the like; benzene thiosulfonic acid; benzenesulfinic acid; benzenesulfonamide; and the like.

The photographic emulsion for use in the invention may be spectrally sensitized by adding methine dyes or the like to the emulsion before completion of formation of grains, before the emulsion is applied to an appropriate support, or during the chemical ripening process of the emulsion. Dyes for use in the invention include cyanine dyes, merocyanine dyes, composite cyanine dyes, composite merocyanine dyes, holopolar cyanine dyes, hemicyanine dyes, styryl dyes, and hemioxonole dyes. Dyes belonging to cyanine dyes, merocyanine dyes and composite merocyanine dyes are particularly useful. Any nuclei for usual use in cyanine dyes as basic heterocyclic nuclei are applicable to these dyes.

A dye which itself has no spectral sensitizing action, or a substance which does not substantially absorb visible light but which shows strong color sensitization may be contained in the emulsion together with the sensitizing dye. For example, aminostilbene compounds substituted by a nitrogen-containing heterocyclic group (for example, the compounds mentioned in U.S. Pat. Nos. 2,933,390 and 3,635,721), the condensation product of an aromatic organic acid and formaldehyde (for example, the compound mentioned in U.S. Pat. No. 3,743,510), cadmium salts, azaindene compounds, or the like may be present. Combinations as described in U.S. Pat. Nos. 3,615,613, 3,615,641, 3,617,295, and 3,635,721 are especially useful.

Other various additives can be used in silver halide emulsions for use in the invention. In other words, surface active agents, hardeners, thickening agents, dyestuffs, ultraviolet light absorbing agents, antistatic agents, brightening agents, desensitizers, developing agents, fading preventing agents, mordants, and the like can be used. In addition, a coupler such as a color coupler can be dispersed in an oil for use.

These additives are mentioned specifically in *Research Disclosure* (RD No. 17643), Vol. 176, pages 22 to 31 (December, 1978) and in *The Theory of the Photographic Process* (4th Ed.) edited by T. H. James (1977, MacMillan Publishing Co., Inc.), and the like.

As a binder for use in the silver halide emulsion of the invention, gelatin is suitable but, besides it, gelatin derivatives such as phthalate gelatin, albumin, agar, gum arabic, a cellulose derivative, polyvinyl acetate, polyacrylamide, polyvinyl alcohol, or the like can be used.

Examples of the invention will be described hereinafter. Parts and percentages are by weight unless otherwise indicated. However, the invention is not limited to the examples.

EXAMPLE 1

Method 1 (Comparative Example)

An aqueous solution containing 3% of gelatin and 2% of ammonia was maintained at 50° C. with stirring, and to the gelatin solution, an aqueous silver nitrate solution and an aqueous potassium bromide solution were added at the same time over a period of 60 min., while maintaining the silver potential constant at −40 mV. After completion of the reaction, the desalting process of the reaction mixture was carried out to prepare an emulsion comprising octahedral silver bromide grains having an average particle size of 0.8 micron.

The solution of $1.0\times10^{-4}$ mol/mol-AgBr of Dye-9 as set forth previously in methanol was added to the above-mentioned emulsion under stirring at 50° C., and then the emulsion was ripened at 50° C. for 90 min. A sulfur sensitizer $Na_2S_2O_3$ was not added because it was found that its addition to the emulsion during the chemical ripening reduced the sensitivity of emulsion. Subsequently, the above-mentioned emulsion was applied to a triacetyl cellulose film support and dried to prepare a film sample.

The film was exposed to a tungsten bulb (a color temperature of 2854° K.) for 1 second through a continuous wedge and a color filter. As the color filter, Fuji gelatin filter BPN42 (a product of Fuji Photo Film Co., Ltd.) was used for blue exposure for exciting the silver halide, and Fuji gelatin filter SC52 (a product of Fuji Photo Film Co., Ltd.) was used for minus blue exposure for exciting the dye. The exposed film was developed at 20° C. for 10 min using the following surface developing solution MAA-1.

| Surface developing solution MAA-1 | |
|---|---|
| Metol | 2.5 g |
| L-ascorbic acid | 10 g |
| Navox (a product of Fuji Photo Film Co., Ltd.) | 35 g |
| Potassium bromide | 1 g |
| Water to make (pH 9.8) | 1 liter |

The developed film was measured for the optical density with a Fuji recording densitometer and the sensitivity of the emulsion was represented by the reciprocal of the exposure amount required to provide an optical density of fog plus 0.1.

Method 2 (The Invention)

After the same formation process of silver bromide grains as in method 1 was carried out, the chemical ripening process was carried out as follows. An aqueous solution of $5.7\times10^{-4}$ mol/molAgBr of $K_3IrCl_6$ was added to the emulsion while stirring at 50° C., and then the emulsion was ripened at 50° C. for 30 min. Subsequently, a solution of $1.0\times10^{-4}$ mol/molAgBr of Dye-9 in methanol was added to the emulsion and the emulsion was ripened at 50° C. for 30 min. Further, an aqueous $Na_2S_2O_3$ solution was added to the emulsion in the optimum $Na_2S_2O_3$ amount of $4.2\times10^{-6}$ mol/molAgBr, and then the emulsion was ripened at 50° C. for 60 min.

Method 3 (Comparative Example)

Method 3 was the same as Method 1, except that Dye-9 was added to the emulsion before application of the emulsion, instead of being added before the chemical ripening process. However, $Na_2S_2O_3$ was used in the optimum amount of $2.5\times10^{-5}$ mol/molAgBr.

Method 4 (Comparative Example)

Method 4 was the same as Method 1, except that Dye-9 was not added to the emulsion. However, $Na_2S_2O_3$ was used in the optimum amount of $5.0\times10^{-5}$ mol/molAgBr.

Method 5 (Comparative Example)

Method 5 was the same as Method 2, except that Dye-9 was added to the emulsion before application of the emulsion instead of being added before the chemical ripening process. However, $Na_2S_2O_3$ was used in the optimum amount of $4.2\times10^{-4}$ mol/molAgBr.

Method 6 (Comparative Example)

Method 6 was the same as method 2, except that Dye-9 was not added to the emulsion. However, $Na_2S_2O_3$ was used in the optimum amount of $2.1\times10^{-4}$ mol/molAgBr.

Sensitivity values of emulsions obtained in experiments of the above-mentioned methods 1 through 6 are shown in Table 1.

TABLE 1

| Experiment | Blue Sensitivity (Relative Value) | Minus blue Sensitivity (Relative Value) |
|---|---|---|
| Method 1 (Comparative Example) | 17 | 54 |
| Method 2 (Invention) | 110 | 270 |
| Method 3 (Comparative Example) | 47 | 100 (Control) |
| Method 4 (Comparative Example) | 100 (Control) | 0 |
| Method 5 (Comparative Example) | 49 | 87 |
| Method 6 (Comparative Example) | 123 | 0 |

The sensitivity values as shown in Table 1 indicate clearly that high sensitivity values of emulsions can be obtained by carrying out chemical sensitization and spectral sensitization of an emulsion in accordance with the method of the invention.

EXAMPLE 2

Method 7 (Comparative Example)

An aqueous solution containing 3% gelatin and 2% ammonia was maintained at 50° C., and to the gelatin solution, an aqueous silver nitrate solution and an aqueous potassium bromide solution were added at the same time over a period of 60 min, maintaining the silver potential of the reaction solution constant at −40 mV while stirring at 50° C. After completion of the reaction, the desalting process of the reaction solution was carried out to prepare a photographic emulsion comprising octahedral silver bromide grains having an average particle size of 0.8 micron.

A solution of $1.0\times10^{-4}$ mol/molAgBr of Dye-9 in methanol was added to the emulsion while stirring at 50° C., and the solution was ripened at 50° C. for 30 min. After that, an aqueous gold.sulfur sensitizing agent $Na_3Au(S_2O_3)_2$ solution having a concentration of $6.7\times10^{-6}$ mol/molAgBr was added to the emulsion and the emulsion was ripened at 50° C. for 60 minutes. Subsequently, the above-mentioned emulsion was applied to a triacetylcellulose support and dried to prepare a film sample.

The above-mentioned film was used to carry out the same experiment as in Method 1, and the sensitivity value of the film was measured.

Method 8 (The Invention)

After the same formation process of silver bromide grains as in method 7 was carried out, the chemical ripening process of the emulsion was carried out as follows. While maintaining the emulsion at 50° C. with stirring, $K_3IrCl_6$ was added thereto in an aqueous solution state at a concentration of $5.7\times10^{-4}$ mol/molAgBr, and the mixture was ripened for 30 minutes. Subsequently, a solution of Dye-9 used in Method 1 in methanol was added to the solution in an amount of Dye-9 of $1.0\times10^{-4}$ mol/molAgBr, and then the emulsion was ripened at 50° C. for 30 min. Further, an aqueous $Na_3Au(S_2O_3)_2$ solution was added to the emulsion in the optimum amount of $Na_3Au(S_2O_3)_2$ of $4.2\times10^{-5}$ mol/molAgBr, and then the emulsion was ripened at 50° C. for 60 min.

Method 9 (Comparative Example)

Method 9 was the same as Method 7, except that Dye-9 was added to the emulsion before application of the emulsion instead of being added before the chemical ripening process. However, $Na_3Au(S_2O_3)_2$ was used in the optimum amount of $6.7\times10^{-6}$ mol/molAgBr.

Method 10 (Comparative Example)

Method 10 was the same as Method 7, except that Dye-9 was not added to the emulsion. However, $Na_3Au(S_2O_3)_2$ was used in the optimum amount of $6.7\times10^{-6}$ mol/molAgBr.

Method 11 (Comparative Example)

Method 11 was the same as Method 8, except that Dye-9 was added to the emulsion before application of the emulsion instead of being added before the chemical ripening process. However, $Na_3Au(S_2O_3)_2$ was used in the optimum amount of $4.2\times10^{-5}$ mol/molAgBr.

Method 12 (Comparative Example)

Method 12 was the same as Method 8, except that Dye-9 was not added to the emulsion. However, $Na_3Au(S_2O_3)_2$ was used in the optimum amount of $4.2\times10^{-5}$ mol/molAgBr.

Sensitivity values obtained in the experiments of the above-mentioned methods 7 through 12 are shown in Table 2.

TABLE 2

| Experiment | Blue Sensitivity (Relative Value) | Minus Blue Sensitivity (Relative Value) |
|---|---|---|
| Method 7 (Comparative Example) | 20 | 30 |
| Method 8 (Invention) | 100 | 300 |
| Method 9 (Comparative Example) | 30 | 100 (Control) |
| Method 10 (Comparative Example) | 100 (Control) | 0 |
| Method 11 (Comparative Example) | 15 | 20 |
| Method 12 (Comparative Example) | 100 | 0 |

The sensitivity values as shown in Table 2 indicate clearly that high sensitivity values of emulsions could be obtained by carrying out chemical sensitization and spectral sensitization of the emulsion in accordance with the method of the invention.

While the invention has been described in detail and with reference to specific embodiments thereof, it will be apparent to one skilled in the art that various changes and modifications can be made therein without departing from the spirit and scope thereof.

What is claimed is:

1. A method for manufacturing a chemically and spectrally sensitized silver halide emulsion, which comprises carrying out chemical ripening of the emulsion in the presence of an iridium salt and 0.01 to 10 mmol per mol of the silver halide of a photographic carbocyanine spectral sensitizing dye which forms J-aggregates.

2. A method for manufacturing a chemically and spectrally sensitized silver halide emulsion as in claim 1, wherein the spectral sensitizing dye is added during a period from the beginning of chemical ripening to a time point corresponding to 50% of the chemical ripening.

3. A method for manufacturing a chemically and spectrally sensitized silver halide emulsion as in claim 2, wherein the spectral sensitizing dye is added during a period from the beginning of chemical ripening to a time point corresponding to 20% of the chemical ripening.

4. A method for manufacturing a chemically and spectrally sensitized silver halide emulsion as in claim 1, wherein the sensitizing dye is present in an amount of from 0.1 to 1 mmol per mol of silver halide.

5. A method for manufacturing a chemically and spectrally sensitized silver halide emulsion as in claim 1, wherein the iridium salt is added during a period from the beginning of chemical ripening to a time point corresponding to 50% of the chemical ripening.

6. A method for manufacturing a chemically and spectrally sensitized silver halide emulsion as in claim 5, wherein the iridium salt is added during a period from the beginning of chemical ripening to a time point corresponding to 20% of the chemical ripening.

7. A method for manufacturing a chemically and spectrally sensitized silver halide emulsion as in claim 1, wherein the iridium salt is added during a period from a time point at which 70% or more of the whole of a silver salt solution used for forming the emulsion has been added to a gelatin solution for forming the emulsion to the completion of addition of the whole of the silver salt solution.

8. A method for manufacturing a chemically and spectrally sensitized silver halide emulsion as in claim 7, wherein the iridium salt is added during a period from a time point at which 80% or more of the whole of a silver salt solution used for forming the emulsion has been added to a gelatin solution for forming the emulsion to the completion of addition of the whole of the silver salt solution.

9. A method for manufacturing a chemically and spectrally sensitized silver halide emulsion as in claim 8, wherein the iridium salt is added during a period from a time point at which 90% or more of the whole of a silver salt solution used for forming the emulsion has been added to a gelatin solution for forming the emulsion to the completion of addition of the whole of the silver salt solution.

10. A method for manufacturing a chemically and spectrally sensitized silver halide emulsion as in claim 1, wherein the iridium salt exists in the form of a ligand salt wherein the ligands are selected from the group consisting of $Cl^-$ and $Br^-$.

11. A method for manufacturing a chemically and spectrally sensitized silver halide emulsion as in claim 1, wherein the iridium ions are present in an amount of from $10^{-6}$ to $10^{-3}$ mol per mol of silver halide present in the silver halide emulsion.

12. A method for manufacturing a chemically and spectrally sensitized silver halide emulsion as in claim 11, wherein the iridium ions are present in an amount of from $10^{-5}$ to $10^{-3}$ mol per mol of silver halide present in the silver halide emulsion.

13. A method for manufacturing a chemically and spectrally sensitized silver halide emulsion as in claim 1, wherein the silver halide emulsion is a monodispersed silver halide emulsion.

14. A method for manufacturing a chemically and spectrally sensitized silver halide emulsion as in claim 13, wherein the monodispersed silver halide emulsion has a particle size distribution of grains such that 90% or more of the entire number of grains or the entire weight of grains have a particle size within ±40% of the average particle size of grains.

15. A method for manufacturing a chemically and spectrally sensitized silver halide emulsion as in claim 1, wherein the form of the silver halide grains is octahedral, tetradecahedral, plate-like, or pebble-like.

16. A method for manufacturing a chemically and spectrally sensitized silver halide emulsion as in claim 15, wherein the form of silver halide grains is plate-like or octahedral.

17. A method for manufacturing a chemically and spectrally sensitized silver halide emulsion as in claim 16, wherein the form of silver halide grains is octahedral.

18. A method for manufacturing a chemically and spectrally sensitized silver halide emulsion as in claim 1, wherein the silver halide grains have a crystal face (111) of 30% or more in relation to the total surface area.

19. A method for manufacturing a chemically and spectrally sensitized silver halide emulsion as in claim 18, wherein the silver halide grains have a crystal face (111) of 60% or more in relation to the total surface area.

20. A chemically and spectrally sensitized silver halide emulsion, prepared by a process which comprises carrying out chemical ripening of the emulsion in the presence of an iridium salt and 0.01 to 10 mmol per mol of the silver halide of a photographic carbocyanine spectral sensitizing dye which forms J-aggregates.

21. A chemically and spectrally sensitized silver halide emulsion as in claim 20, wherein the spectral sensitizing dye is added during a period from the beginning of chemical ripening to a time point corresponding to 50% of the chemical ripening.

22. A chemically and spectrally sensitized silver halide emulsion as in claim 20, wherein the iridium salt is added during a period from the beginning of chemical ripening to a time point corresponding to 50% of the chemical ripening.

23. A chemically and spectrally sensitized silver halide emulsion as in claim 20, wherein the iridium salt is added during a period from a time point at which 70% or more of the whole of a silver salt solution used for forming the emulsion has been added to a gelatin solution for forming the emulsion to the completion of addition of the whole of the silver salt solution.

24. A chemically and spectrally sensitized silver halide emulsion as in claim 20, wherein the silver halide emulsion is a monodispersed silver halide emulsion.

25. A chemically and spectrally sensitized silver halide emulsion as in claim 20, wherein the form of silver halide grains is plate-like or octahedral.

26. A chemically and spectrally sensitized silver halide emulsion as in claim 20, wherein the silver halide grains have a crystal face (111) of 30% or more in relation to the total surface area.

27. A method for manufacturing a chemically and spectrally sensitized silver halide emulsion as in claim 1, wherein the silver halide is silver iodobromide, silver iodochlorobromide, silver chlorobromide or silver bromide.

28. A method for manufacturing a chemically and spectrally sensitized silver halide emulsion as in claim 17, wherein the silver halide is silver iodobromide, silver iodochlorobromide, silver chlorobromide or silver bromide.

29. A chemically and spectrally sensitized silver halide emulsion as in claim 20, wherein the form of silver halide grains is octahedral.

30. A chemically and spectrally sensitized silver halide emulsion as in claim 29, wherein the silver halide is silver iodobromide, silver iodochlorobromide, silver chlorobromide or silver bromide.

* * * * *